US005159313A

United States Patent [19]

Kawai et al.

[11] Patent Number: 5,159,313

[45] Date of Patent: Oct. 27, 1992

[54] OIL SUPPLY SYSTEM IN AN INTERNAL COMBUSTION ENGINE FOR A VEHICLE

[75] Inventors: Takeo Kawai; Yukio Nakamura, both of Toyota; Akio Kuramoto, Okazaki, all of Japan

[73] Assignee: Toyota Jidosha Kabushiki Kaisha, Toyota, Japan

[21] Appl. No.: 533,538

[22] Filed: Jun. 5, 1990

[30] Foreign Application Priority Data

Jun. 19, 1989 [JP] Japan ..... 1-154517
Oct. 14, 1989 [JP] Japan ..... 1-267736

[51] Int. Cl.[5] ..... B60Q 1/00

[52] U.S. Cl. ..... 340/450.3; 123/196 S; 184/103.1; 340/624

[58] Field of Search ..... 340/449, 450, 450.3, 340/618-624; 123/198 D, 196 S; 73/292, 302, 307; 137/386, 558; 184/103.1, 103.2

[56] References Cited

U.S. PATENT DOCUMENTS

| | | | |
|---|---|---|---|
| 4,117,451 | 9/1978 | Sato et al. | 340/450 |
| 4,503,419 | 3/1985 | Kidd et al. . | |
| 4,563,988 | 1/1986 | Weishaupt | 184/103.1 |
| 4,724,926 | 2/1988 | Collins | 123/196 S |
| 4,989,560 | 2/1991 | Rasdal et al. | 123/196 S |

*Primary Examiner*—Jin F. Ng
*Assistant Examiner*—Brent A. Swarthout
*Attorney, Agent, or Firm*—Kenyon & Kenyon

[57] ABSTRACT

An oil supply system for an internal combustion engine, having an oil supplementing pump and an oil level sensor arranged in an oil pan for initiating the operation of the oil supplementing pump. A temperature of the oil is detected every time the engine is stopped, and this value is stored. A drop in the temperature of the oil when the engine is started is detected from the stored value of the temperature obtained when the engine was stopped. When a drop of the engine temperature is larger than a predetermined value, an oil supplementing operation is carried out.

10 Claims, 6 Drawing Sheets

OIL SUPPLY SYSTEM IN AN INTERNAL COMBUSTION ENGINE FOR A VEHICLE

BACKGROUND OF THE INVENTION

1. Field of the Invention

The present invention relates to an apparatus for automatically supplying a lubricant oil to an internal combustion engine for a vehicle by detecting a shortage in the amount of the oil. The apparatus is suitably applied to a one-box type vehicle wherein the engine body is arranged under a driver's seat in a vehicle compartment, and therefore, it is difficult to service the engine for maintenance purposes.

2. Description of the Related Art

Japanese Unexamined Patent Publication No. 62-93417 proposes an automated apparatus for supplying lubrication oil in an internal combustion engine for a vehicle, whereby an automatic supply of lubricant oil is carried out when a lowering of the oil level with respect to a predetermined level in an oil pan is detected after a predetermined time has elapsed from the time of stopping the engine, which has been operated for at least a time in which the temperature of the oil is increased, which determines the viscosity of the oil. A timer circuit is provided for continuing the operation of a control circuit, which allows a detection of an oil level in the oil pan for a predetermined time after the ignition key switch is made OFF for stopping the engine. As a result, the measurement of the oil level is carried out while the oil level in the oil pan is in a stabilized condition, for a precise detection of any shortage in the amount of oil in the oil pan.

In the prior art, to allow enough time to pass for the oil level in the oil pan to settle after the engine is stopped, a timer means is provided for detecting a predetermined time after the ignition key switch is made OFF, and a detection of the oil level in the oil pan is carried out after the lapse of this predetermined time. Namely, the control circuit must continue to operate after the ignition key switch is made OFF, so that the detection of the oil level can be executed after the lapse of the predetermined time, after which the control circuit is made OFF by the timer circuit. This means that the prior art requires extra parts such as a timer for energizing the control circuit after the ignition key switch is made OFF, and that the load on the battery is increased because the control circuit is energized after the engine is stopped.

SUMMARY OF THE INVENTION

An object of the present invention is to provide a system capable of detecting the level of the lubrication oil in the oil pan after the lapse of a predetermined time from the switching off of the ignition key switch, without the necessity for a continuation of the energizing of the control circuit.

According to the present invention, a system is provided for supplying a lubrication oil in an internal combustion engine, comprising:

an oil pan mounted at the bottom of the internal combustion engine, for storing a predetermined amount of the lubrication oil;

a first sensor means for detecting a level of the oil stored in the oil pan;

a second sensor means for detecting the temperature of the internal combustion engine;

means for storing the value of the temperature detected by the second sensor means when the engine is stopped;

means for determining the condition of the recovery of the oil in the oil pan, based on the difference between the temperature stored in the storing means and a temperature detected by the second sensor means when the engine is started, and;

an oil supplementing means for supplementing the amount of oil stored in the oil pan when the oil level in the oil pan sensed by the first sensor means is lower than a predetermined value, after the recovered condition of the oil in the oil pan is detected by the detecting means.

DESCRIPTION OF THE PREFERRED EMBODIMENT

Figures 1, 2:
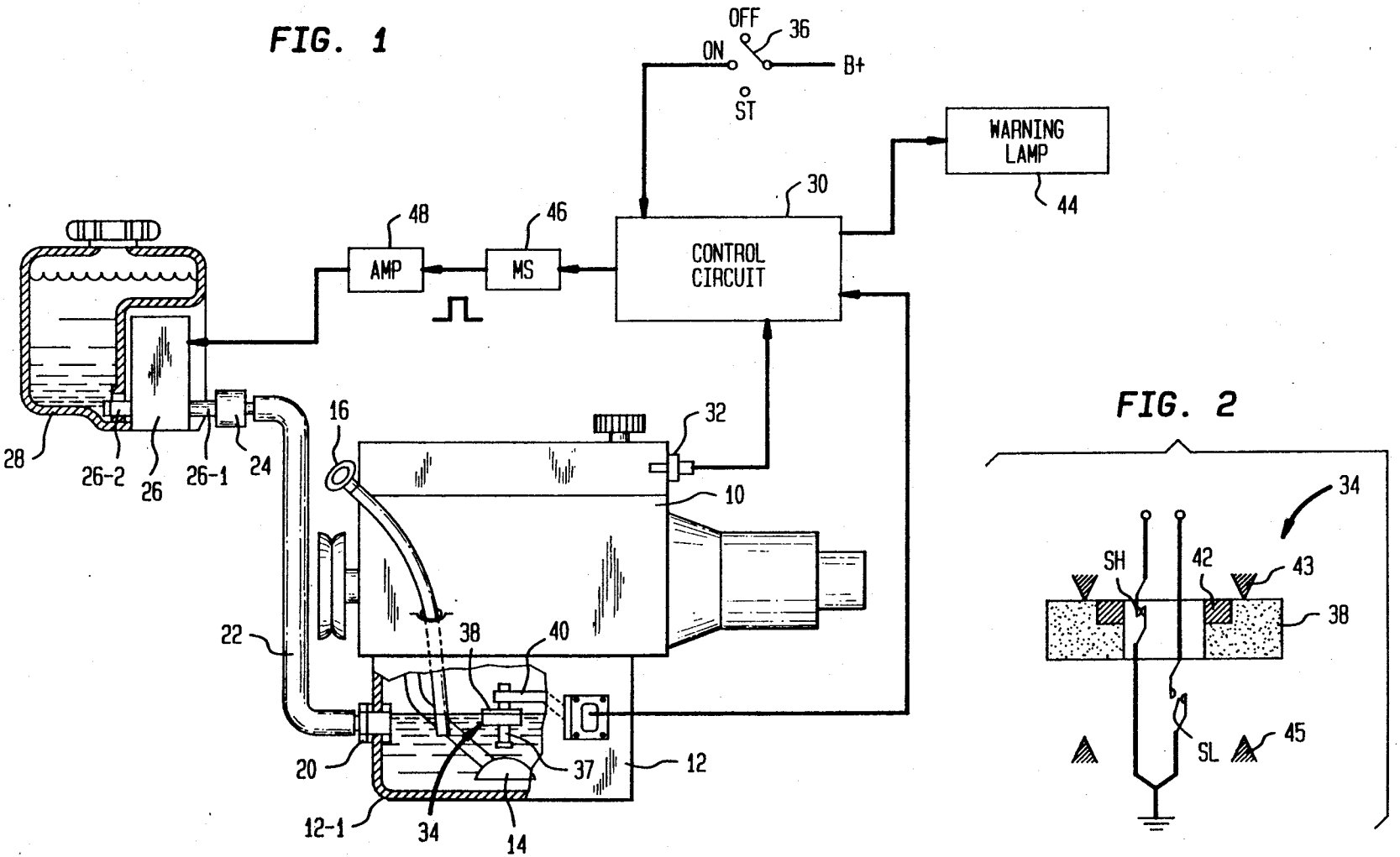
FIG. 1 is a general schematic view of the system according to the present invention.
FIG. 2 is a schematic vertical cross-sectional view of the oil level sensor according to the present invention.

In FIG. 1, 10 denotes a body of an internal combustion engine. An oil pan 12 is mounted at the bottom of the engine body 10, a strainer 14 is arranged in the oil pan 12 below the surface level of the engine lubricant oil stored in the oil pan 12, and a bottom end of an oil level gauge 16 is inserted into the lubricant oil from above. The oil pan 12 is provided with a side wall 12-1 to which an oil inlet 20 is connected, and the oil inlet 20 is connected, via an oil supply pipe 22 and a check valve 24, to an electrically operated oil supplementing pump 26 at an oil delivery port 26-1 thereof. A bottom end of an oil reservoir tank 28 is connected to the oil supplementing pump 26 at an oil induction port 26-2 thereof.

A control circuit 30 for controlling the oil supplementing operation in accordance with the present invention is constructed as a microcomputer system, and to carry out the fuel supplementing operation according to the present invention, an engine cooling water temperature sensor 32 and oil level sensor 34 are connected to the control circuit 30. The control circuit 30 is energized by a battery when an ignition key switch 36 of the engine is made ON. The temperature sensor 32 detects the temperature of cooling water of the engine, and the oil level sensor 34 is provided with a central sleeve 37, an annular float 38 vertically movably mounted on the central sleeve 37, and an arm 40 extending from an inner wall of the engine body and holding the central sleeve 37 stationary. As shown in FIG. 2, a pair of vertically spaced apart magnetic switches SH and SL, such as a reed switch, are arranged inside the sleeve 37, and a ring-shaped permanent magnet member 42 is mounted in the float member 38 in such a manner that the axis of the ring-shaped magnet member 42 is on a vertical line. A pair of vertically spaced apart stoppers 43 and 45 are also provided, and when the level of the oil in the oil pan 12 is higher than a predetermined level, the float 38 is urged under its own buoyancy into contact with the upper stopper 43, as shown in FIG. 2. In this position, the magnet member 43 faces the upper switch SH and makes it ON. When the level of the oil in the oil pan 12 is lower than the predetermined level, the float 38 sinks downward, and the magnet 42 is displaced from the position facing the upper limit switch SH, which is thus made OFF. As fully described later, this allows the oil supplementing operation to be commenced under a predetermined condition. The function of the lower limit switch SL is to detect malfunctions, and is usually OFF because the float member 38 is usually in a position such that the magnet member 42 is located above and remote from the lower limit switch SL. If the level of the oil becomes abnormally low for some reason, the float member 38 sinks to a position at which it is in contact with the bottom stoppers 45, and accordingly, the magnet member 42 faces the lower limit switch SL, making it ON, and thus a warning lamp 44 is lit. It should be noted that the sensor 34 is located on the vertical center line of the space formed inside the oil pan 12, and therefore, the position of the sensor 34 with respect to the oil level surface in the oil pan 12 is substantially unchanged when the angle of the oil level surface with respect to the side wall 12-1 of the oil pan 12 is changed when the vehicle is parked, for example, on a sloping road surface, and accordingly, the precision of the detection of the oil level is increased.

According to this embodiment of the present invention, a sensor is not provided in the reservoir tank 28, for detecting the oil level in the reservoir tank 28, since as described later, it can be indirectly determined that the reservoir tank 28 is empty by judging that the total number of consecutive cycles of operation of the oil pump 26 is larger than a predetermined value, during the time in which a supply of oil is required.

When the control circuit 30 judges that the oil in the oil pan 12 must be supplemented, a predetermined number of pulsative operations of the oil supplementing pump 26 is executed for each operating cycle carried out when the engine is started. The control circuit 30 controls this operation by outputting signals, via a monostable multivibrator 46 and an amplifier 48, to the oil supplementing pump 26.

Figure 3:
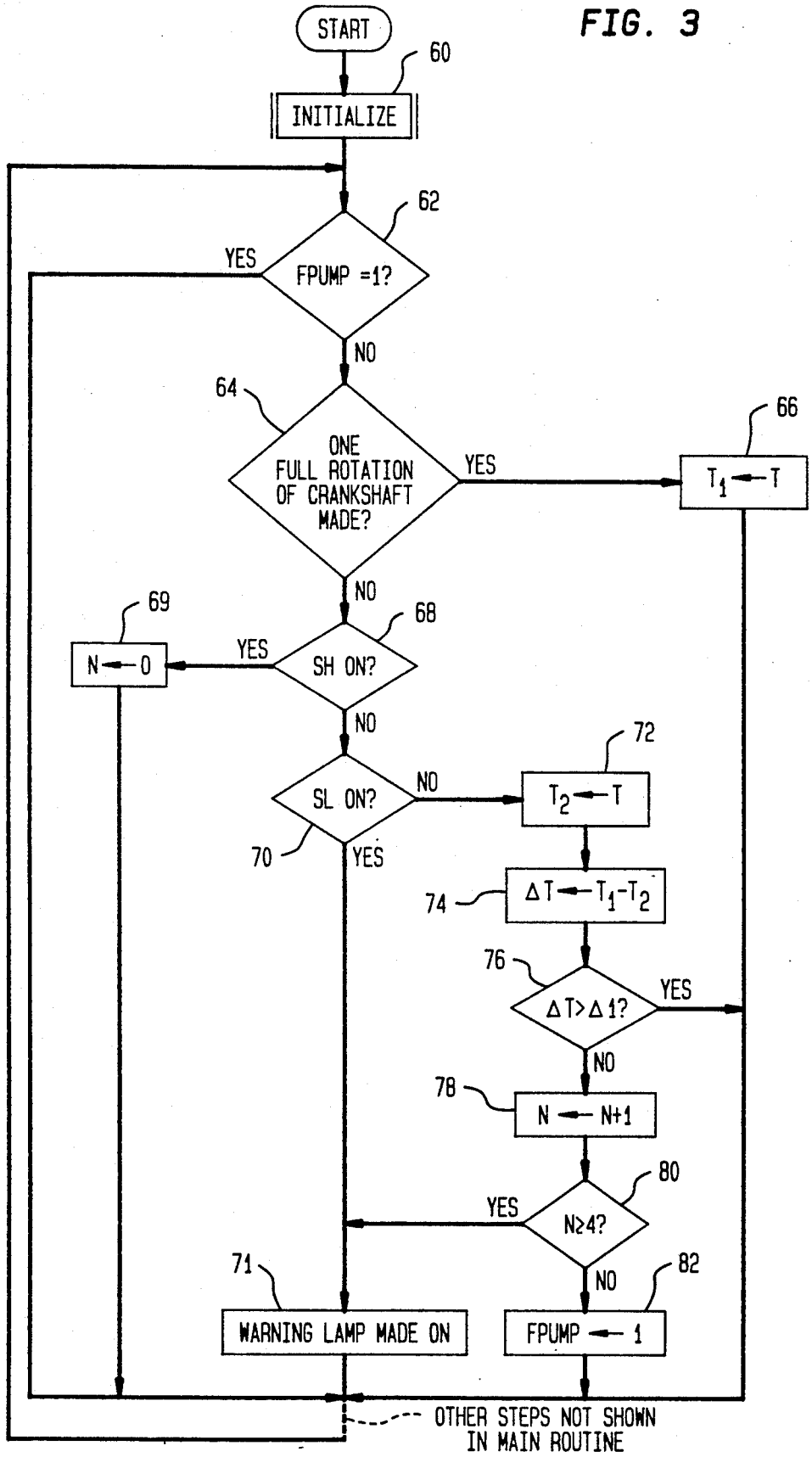
FIGS. 3 and 4 are flow charts illustrating the operation of a control circuit of FIG. 1.

The operation of the control circuit 30 will be described with reference to the flowcharts of FIGS. 3 and 4. FIG. 3 shows a main routine executed whenever the ignition key switch 36 is made ON. At step 60, registers in the CPU and RAM and the like are initialized, and at step 62 it is determined if a flag FPUMP is 1. This flag FPUMP is set when a supplementing of the oil in the oil pan 12 is required. If a supplementing of the oil is not required, i.e., FPUMP=1, the routine goes to step 64 where it is determined if one full rotation of the crankshaft has been made after the engine has been cranked by a starter. When the engine crankshaft is rotating, the oil stored in the oil pan is agitated, and therefore, a detection of the oil level of the oil in the oil pan 12 by the oil level switch 34 becomes impossible. Namely, a correct detection of the oil level in the oil pan 12 by the oil level sensor 34 can be carried out only when the oil in the oil pan 12 has settled and is not moving. To confirm the stationary condition of the oil level in the oil pan 12, the detection of the oil level in this embodiment is carried out before one full rotation of the crankshaft is made, after the ignition key switch is made ON. Nevertheless, the present invention is not limited to this particular value of one revolution of the crankshaft, and a desired value of a number of revolutions can be selected to obtain the desired effect. When one full revolution of the crankshaft has been made, the routine goes to step 66, where the value of the engine cooling water temperature T sensed by the sensor 32 is moved to $T_1$. This value will be used for calculating a temperature difference $\Delta T$, which is a reference value for determining whether the engine is in a state in which a detection of oil level in the oil pan 12 is possible. It should be noted that the data of the temperature $T_1$ is stored in a non-volatile RAM.

When it is determined that one full rotation of the crankshaft has not been made, after the start of the cranking operation the routine goes from step 64 to step 68, where it is determined if the upper limit switch SH is ON. When the limit switch SH is ON, this denotes that the oil in the oil pan 12 is at a required level, and the routine goes to step 69 where a counter is cleared. This counter N counts the number of repetitions of the pulsative operations of the oil supplementing pump 26 for one oil supply operation carried out when the engine is started.

When it is determined that the upper limit switch is OFF, this denotes that the oil level is lower than a predetermined value. In this case, the routine goes from step 68 to step 70, where it is determined if the lower limit switch SL has been made ON. When the oil level is approaching a level at which the lower limit switch SL will be made ON, an oil supplementing operation is usually carried out to prevent the oil level from sinking to a level at which the lower limit switch SL is made ON. Therefore, if the lower limit switch SL is ON, then a malfunction of the system has occurred, and accordingly, the routine goes to step 71 where a warning operation such as the lighting of the warning lamp 44 is carried out.

When it is determined that the lower limit switch SL is OFF, it is judged that the oil level is between the SH contact and SL contact, and thus the routine goes to step 72 where the value of the temperature T sensed by the engine water temperature sensor 32 is moved to $T_2$, to store the engine temperature when the engine is started. Then at step 74, the value of the temperature $T_1$, which is the temperature of the engine water when the engine was stopped, is subtracted by the value of the temperature $T_2$ and is moved to $\Delta T$, which denotes a temperature of the engine cooling water lower than the value of the temperature of the engine cooling water when the ignition key switch 36 was last made OFF. This change of the temperature $\Delta T$ corresponds, as will be fully described later, to a degree of the recovery of the oil level in the oil pan, which is changed in accordance with a lapse of time after the ignition key switch is made OFF. At step 76, it is determined if the value $\Delta T$ is larger than a predetermined lowest value $\Delta 1$, which is a value of a drop in the temperature of the engine cooling water, which corresponds to a predetermined time required to reach a condition in which oil which has lubricated various parts of the engine is substantially completely returned to the oil pan 12 after the engine has stopped. When it is determined that $\Delta T > \Delta 1$, i.e., when the engine is just started, sufficient time has elapsed from the time at which the ignition key switch is made OFF to obtain a complete recovery of the oil level in the oil pan 12, and it is considered that a precise detection of the oil level in the oil pan 12 can be carried out by the switches SH and SL. Therefore, it is determined that, when the upper limit switch SH is OFF (No at step 68), there is a shortage in the amount of oil in the oil pan 12. When $\Delta T > \Delta 1$ at step 76, the routine goes to step 78 and a cycle counter N is incremented by 1. This counter N is incremented when the engine, in which the oil was supplemented when it was previously started, is again in an oil supplementing state. It is possible to detect that the reservoir tank 28 is empty from the value of the counter. Namely, when the value of the counter is high but the oil level in the oil pan 12 is not changed, i.e., although the oil supplementing pump 26 is operating, the level of the oil in the oil pan 12 remains the same, then it can be determined that the reservoir tank 28 is empty. It should be noted that, to hold the value of the counter N when the ignition key switch 36 is made OFF, the value of the counter N should be stored in a nonvolatile RAM.

At step 80, it is determined if the value of the counter N is equal to or larger than 4. When it is determined that $N<4$, i.e., it is determined that a shortage of oil has been detected at four or more consecutive starting operations of the engine, the routine goes from the step 80 to step 82, where the flag FPUMP is set. This flag allows the oil supplementing pump 26 to be operated, as will be described later.

When the value of N is equal to or larger than 4, this means that consecutive determinations of a shortage of oil for a number of consecutive engine starting operations equal to or larger than 4 have been made, and thus it is possible that the oil supplementing operation is not operating normally and correctly. Accordingly, the routine goes to step 71 and the warning lamp 44 is lit. Since the counter N is cleared while the level of the oil in the oil pan 12 is higher than a predetermined value at which the switch SL is made ON (steps 68 and 69), the value of the counter N corresponds to the number of oil supplementing operation cycles carried out upon consecutive starting operations. When an amount of oil, even if small, remains in the reservoir tank 28, consecutive determinations of the need for the oil supplementing operation are not made, and thus the counter N is cleared at step 90. Contrary to this, when there is no oil in the reservoir tank 28, the value of the counter N will be continuously increased at step 78. Therefore, it is possible to detect from the value of the counter N that the reservoir tank 28 is empty. In the illustrated embodiment, when the oil supplementing operations are carried out for four consecutive starting operations, the condition $N=4$ is obtained, and thus a YES result is obtained at step 80 and step 82 is bypassed, to thereby stop the operation of the oil supplementing pump 26. Then the routine goes to the step 71 and the warning lamp 44 is lit. Note, since the operation of the oil supplementing pump 26 is prohibited when the reservoir tank 28 is empty, rotation of the oil supplementing pump 26 under a no-load condition is prevented, and thus the operating life of the pump 26 is prolonged.

Figure 4:
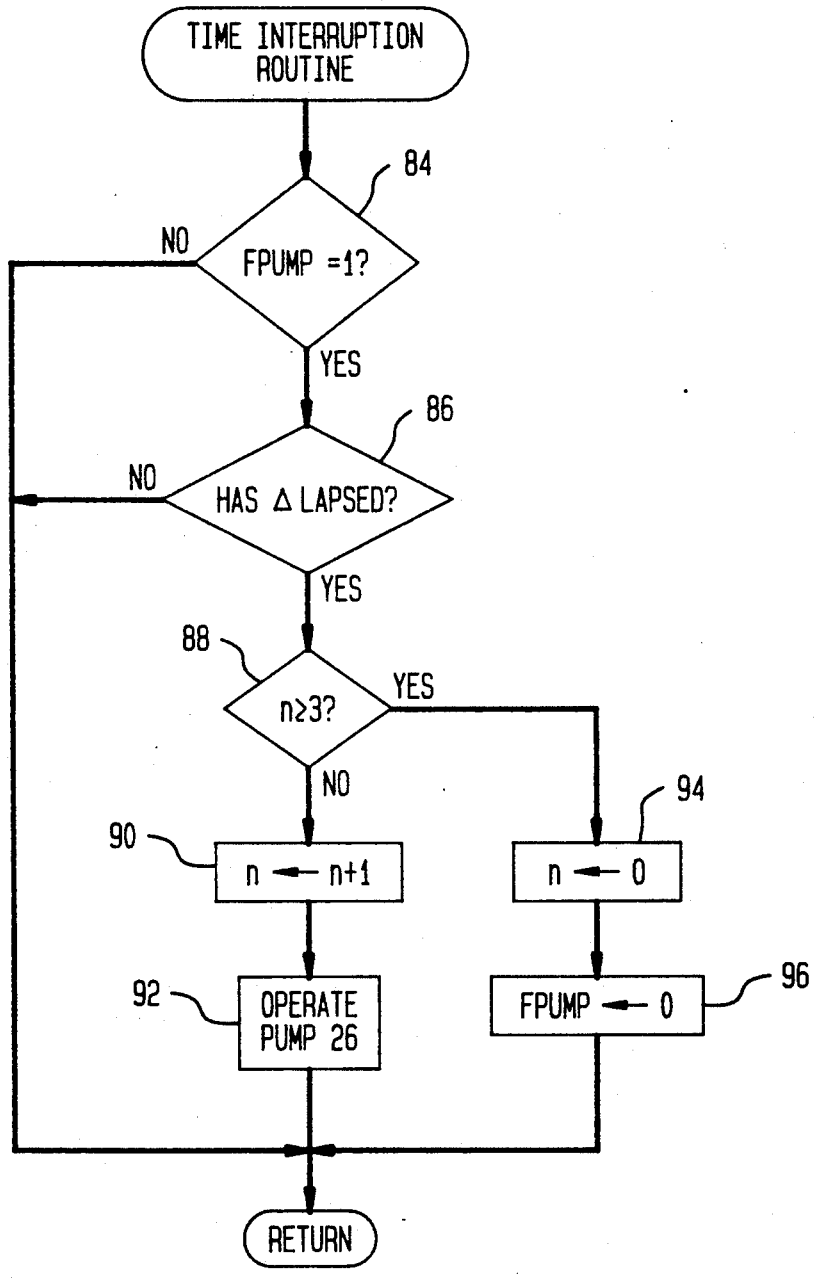

FIG. 4 is a time interruption routine carried out at predetermined intervals, for example, every 10 milliseconds. At step 84, it is determined if the flag FPUMP is set, i.e. FPUMP=1. When an oil supplementation is not required, the flag FPUMP does not equal 1, i.e., NO at step 84, and the routine from step 86 is bypassed. When an oil supplementation is required, i.e., FPUMP =1, then the routine goes to step 86 and it is determined if a predetermined time $\Delta$, for example, 120 seconds, has elapsed from the preceding output of the pump operating pulse signal. When it is determined that the predetermined time $\Delta$ has not elapsed, the routine from step 88 is bypassed.

Figure 5:
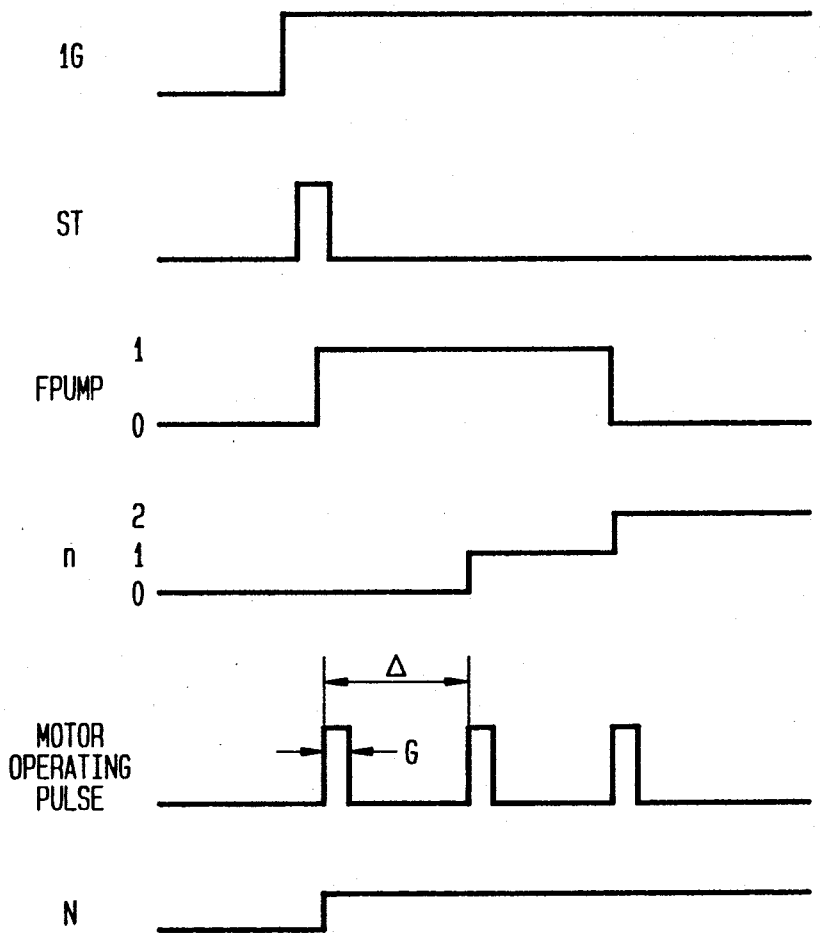
FIGS. 5(*a*), 5(*b*), 5(*c*), 5(*d*), 5(*e*) and 5(*f*) are timing charts illustrating diagrammatic timing operations of the system according to the present invention.

When it is determined that the predetermined time $\Delta$ has elapsed since the preceding output of the pump operating pulse signal, the routine goes to step 88 and it is determined if the counter n for counting the number of pulsative operations for one operating cycle carried out when the engine is started up, is 3 or more. The oil supplementing pump 26 has a small volume, and therefore, is easily damaged if continuously operated. Therefore, the pump 26 is pulsatively operated to prolong the service like thereof, as will be fully described later. The counter n counts the number of operating pulses of the pump 26 during one operating cycle thereof carried out at every start up of the engine. When the value of the counter n has not reached the value of 3, i.e., when three pulse signals for operating the pump 26 have not been output at the starting of the engine at this time, the routine goes to step 90 where the value of the counter n is incremented, and then to step 92 where a signal is output to the mono-stable circuit 46, which causes a pulse signal having duration of a time $\delta$, for example, 10 seconds, to be output from the circuit 46 to the pump 26, whereby the oil supplementing pump 26 is operated for the time $\delta$ as shown in FIG. 5(*e*).

When the value of the counter n has reached the value of 3, the routine goes from step 88 to step 94, where the counter n is cleared, and then to step 96 where the flag FPUMP is cleared. It should be noted that the value of n is stored in a non-volatile RAM, and therefore, the value of n is held when the ignition key switch 36 is made OFF before the counter value reaches 3. Therefore, the remaining number of pulsative operations of the pump 26 is carried out at the starting of the engine. For example, assuming that the ignition key switch 36 is made OFF when the value of the counter n is equal to 1. In this case, when the ignition key switch 36 is again made ON to start the engine, the flag FPUMP is equal to 1, and thus a YES result is obtained at step 62 and the following routine is bypassed, whereby the remaining two pulsative operations of the pump 26 are carried out. Namely, where the pulsative operation of the pump 26 is carried out three times, the flag FPUMP is cleared (step 96 of FIG. 4), and thus the oil supplementing routine following step 64 in FIG. 3 is cancelled (YES result at step 62). As a result, the oil supplementing operation is not carried out as long as the next start up of the engine is executed, i.e., the ignition key switch 36 is once made OFF and again made ON.

According to the present invention, to detect a stationary condition of the oil stored in the oil pan 12, a drop $\Delta T$ in the temperature $T_2$ of the engine cooling water upon a start-up of the engine is calculated with respect to the engine cooling water temperature $T_1$ obtained at the preceding stop of the engine. Note, instead of the detection of a drop in the engine cooling water temperature, a drop in the temperature of the oil may be detected.

Figure 6:
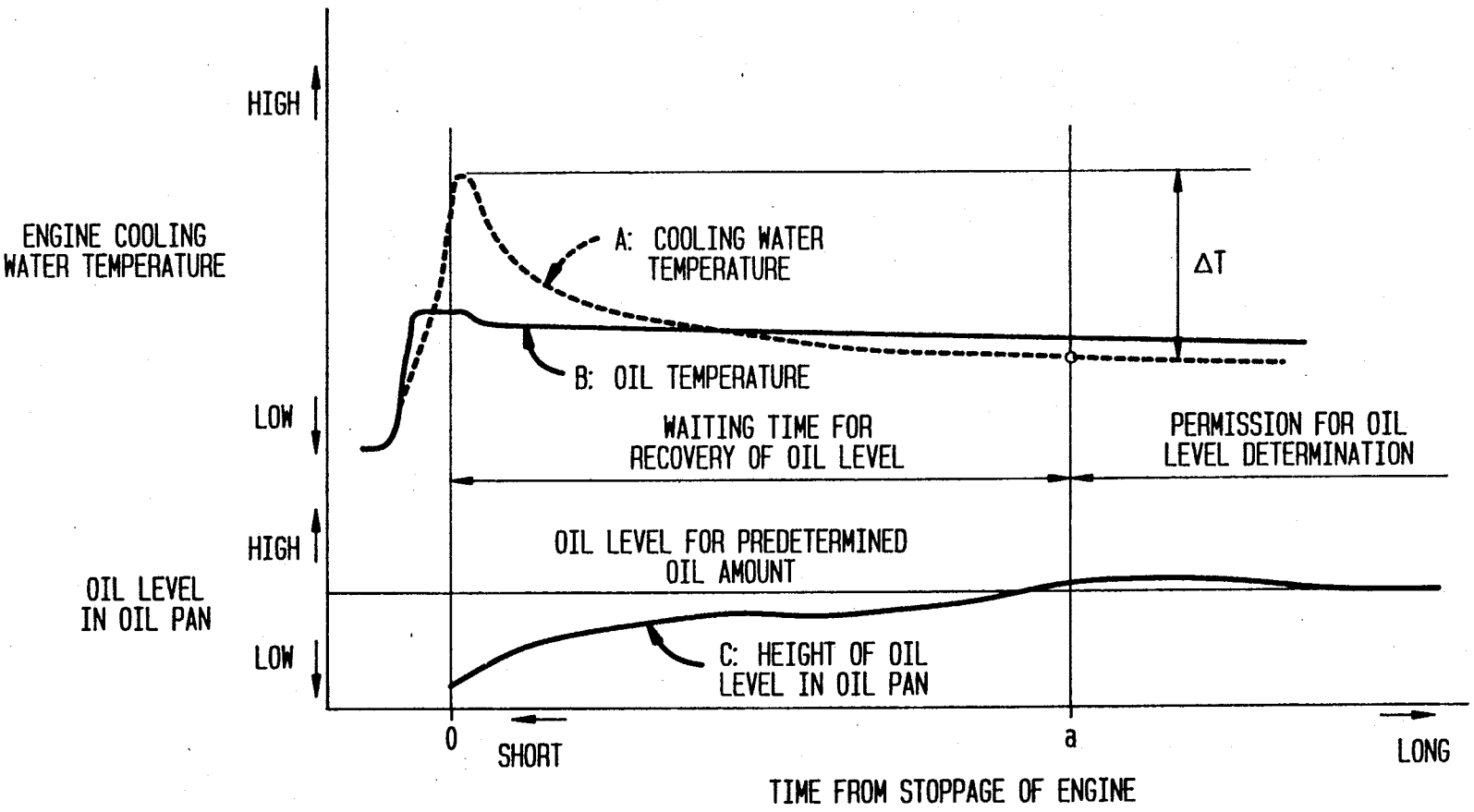
FIG. 6 shows the relationship between the oil level and the oil temperature in the oil pan and the engine water temperature with respect to the lapse of time after the engine has been stopped.
Figure 7:
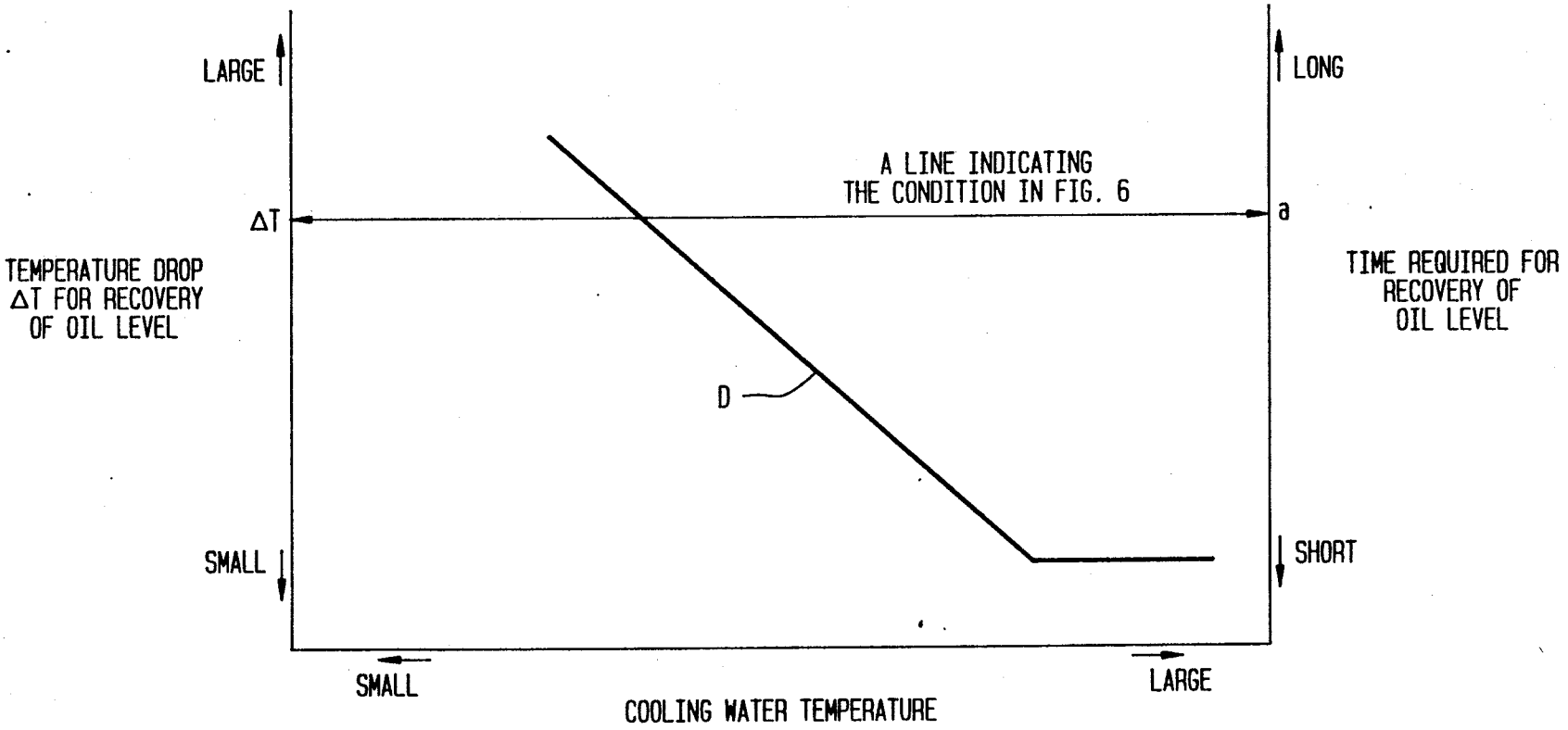
FIG. 7 shows the relationship between a time required for obtaining a recovery of oil in the oil pan after stopping the engine, with respect to the temperature of the engine when it is stopped.

In FIG. 6, lines A, B, and C schematically show changes in the engine cooling water temperature, engine oil temperature, and the height of the oil level in the oil pan 12, respectively, with respect to the lapse of time after the stopping of the engine in a very cold weather condition, such as −30 degrees centigrade, in a strong wind. In FIG. 6, a time shown by a is that required for the oil level to return to the stationary state. The value of the time a was 18 minutes when the engine temperature was 10 degree centigrade at the time of stopping. In FIG. 7 a curve D shows a relationship between the temperature of the engine $T_1$ when the engine is stopped and the temperature drop $\Delta T$ $(=T_1-T_2)$, which corresponds to the time for the oil level to return to the stationary state. As can be seen, the preset engine cooling water temperature drop $\Delta 1$ as a threshold value in step 76 of FIG. 3 is selected to correspond to the lapse of time a needed for a full recovery of the oil in the oil pan 12 after the engine is stopped.

The following table illustrates, with respect to the number of engine starting operations, a determination of the desired temperature difference, a determination of the detection of a low oil level by the switch SH, a determination of the operation of the oil pump, the value of the number of the counter for counting a number of continuous operations of the oil supplementing pump, a determination of the output of a warning signal, and a determination of the occurrence of an oil supplementing operation between the reservoir tank 28 and the oil pan 12. As shown in the table, the warning lamp was lit at the eleventh and twelfth starting operations.

| Starting No. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Was Temperature Difference Obtained? ($\Delta T > T_1$) | Y | Y | Y | N | Y | Y | Y | Y | N | Y | Y | Y | Y | Y |
| Was Oil Level Low? (SH OFF) | N | N | Y | Y | Y | N | Y | Y | Y | Y | Y | Y | N | N |
| Was Motor Operated? (FPUMP = 1) | N | N | Y | N | Y | N | Y | Y | N | Y | N | N | N | N |
| Count of Consecutive Operations of Pump | 0 | 0 | 1 | * | 2 | 0 | 1 | 2 | * | 3 | 4 | 5 | 0 | 0 |
| Was Warning Lamp Lit? | N | N | N | N | N | N | N | N | N | N | Y | Y | N | N |
| Was Oil Supplement Operation Carried Out? | N | N | N | N | N | N | N | N | N | N | N | Y | N | N |

*: No count

According to the present invention, a precise detection of the oil level for an automatic oil supplementing operation becomes possible even when the engine is frequently stopped and run under very low ambient temperature conditions in which it is difficult to raise the oil to the desired temperature.

The effect of the present invention is that a precise detection of the oil level in the oil pan of the engine is possible without overloading the battery, since the engine oil level is detected from the temperature drop obtained at the start of the engine with respect to the engine. Contrary to this, in the prior art, the engine control circuit continues to operate until a time has lapsed which is needed for a full recovery of the oil in the oil pan, thus increasing the load on the battery.

Although the present invention is described with reference to the attached drawings, many modifications and changes can be made by those skilled in this art without departing from the scope and spirit of the invention.

We claim:

1. A system for supplying a lubrication oil in an internal combustion engine, comprising:

an oil pan mounted to the bottom of the internal combustion engine and storing an amount of lubrication oil therein;

first sensor means for detecting a level of oil stored in the oil pan;

second sensor means for detecting temperature parameters of the internal combustion engine;

means for storing the value of a temperature detected by the second sensor means when operation of the engine is terminated, said storing means storing the temperature until operation of the engine is resumed;

means for determining a recovered state of the oil in the oil pan, based on the difference between the temperature stored in the storing means and a temperature as detected by the second sensor means when the engine is started and a correlation between the temperature difference and an amount of oil recovered in the oil pan; and oil supplementing means for supplementing oil in the oil pan when the oil level in the oil pan sensed by the first sensor means is lower than a predetermined value, after the oil in the oil pan has been fully recovered, as determined by the determining means.

2. A system according to claim 1, wherein said determining means comprise means for storing a first temperature value of the engine when operation of the engine is terminated, means for storing a second temperature value of the engine when the engine is again started, means for calculating a difference between the first temperature value and the second temperature value, and means for outputting a signal to cause an operation of said oil supplementing means when said difference is larger than a predetermined value.

3. A system according to claim 2, wherein said means for storing a first temperature value comprises a nonvolatile memory area for storing the data of the engine temperature, and a means for constantly updating the value of the temperature held in said memory area, during the operation of the engine.

4. A system according to claim 1, wherein said oil supplementing means comprises an oil reservoir tank connected to the oil pan, an oil supplementing pump arranged in the reservoir tank, for supplying oil from the oil tank to the oil pan, an electrically operated motor means connected to the oil supplementing pump, and means for generating an electric signal to be output to the motor means upon receipt of a detection signal from the determining means.

5. A system according to claim 4, wherein said generating means comprises means for generating a pulse signal having a predetermined time, and means for allowing a predetermined number of pulse signals to be introduced into said electrically operated motor means during one operation cycle of the engine.

6. A system according to claim 5, further comprising means for obtaining a number of consecutive starting operations of the engine at which an oil supplementing operation of the oil supplementing means occurs, and means for issuing a warning when said number is larger than a predetermined value.

7. A system according to claim 6, wherein said means for obtaining a number comprises a counter which is incremented upon an occurrence of the oil supplementing operation upon consecutive starting operations of the engine, and cleared upon the first engine starting operation at which there is no occurrence of the oil supplementing operation, and a nonvolatile memory means for storing the data of the counter means.

8. A system according to claim 1, wherein said first sensor means comprises a pair of vertically spaced apart sensor units for detecting a vertically spaced apart position of the oil level, and means for allowing an oil supplementing operation based on signals from these sensor units when the oil level is between two vertically spaced apart positions.

9. A system according to claim 1, further comprising means for allowing a detection of the oil level by the sensor means when the oil in the oil pan is stationary.

10. A system according to claim 9, wherein said detection allowing means comprise means for detecting a number of rotations of a crankshaft after the engine is started, and means for allowing a detection of the oil level when said number of rotations is lower than a predetermined value.

* * * * *